United States Patent [19]

Risseeuw

[11] 4,024,719

[45] May 24, 1977

[54] REINFORCED ROAD FOUNDATION AND METHOD FOR MAKING SAID ROAD FOUNDATION

[75] Inventor: Paul Risseeuw, Velp, Netherlands

[73] Assignee: Akzona Incorporated, Asheville, N.C.

[22] Filed: Feb. 5, 1976

[21] Appl. No.: 655,448

[30] Foreign Application Priority Data

Feb. 8, 1975 Netherlands ..... 7501525

[52] U.S. Cl. ..... 61/50; 61/11; 61/35; 404/72

[51] Int. Cl.[2] ..... E02D 5/00; E01C 3/00

[58] Field of Search ..... 61/35, 11, 50, 30, 53; 404/70, 72, 27

[56] References Cited

UNITED STATES PATENTS

| | | | |
|---|---|---|---|
| 2,577,252 | 12/1951 | Kjelman | 61/11 |
| 3,687,759 | 8/1972 | Werner et al. | 156/181 |
| 3,797,251 | 3/1974 | Shimizu | 61/11 |
| 3,890,802 | 6/1975 | Auriat et al. | 52/426 |
| 3,934,421 | 1/1976 | Daimler et al. | 404/70 |

FOREIGN PATENTS OR APPLICATIONS

| | | | |
|---|---|---|---|
| 2,132,820 | 1/1972 | Germany | 61/50 R |
| 4,538,083 | 2/1970 | Japan | 61/38 |

*Primary Examiner*—Paul R. Gilliam
*Assistant Examiner*—Alex Grosz
*Attorney, Agent, or Firm*—Francis W. Young; Jack H. Hall

[57] ABSTRACT

The invention relates to a method for the preparation of a foundation, in particular, a structure serving as foundation for highways, consisting essentially of soil or other materials.

12 Claims, 2 Drawing Figures

REINFORCED ROAD FOUNDATION AND METHOD FOR MAKING SAID ROAD FOUNDATION

BACKGROUND OF THE INVENTION

In expanding road networks, especially highways, one might consider building entirely new roads as well as widening existing roads. Nowadays, consideration is given mainly to widening existing roads because it presents, in principle, a number of substantial advantages in terms of layout, environment and cost. In widening existing roads, one avoids the paralleling of the land inherent in building new roads as well as further alteration of environment and landscape.

However, widening of existing roads has so far proved very difficult, especially in areas of relatively soft and compressible soil, as frequently found in the western part of Holland, but also in other delta areas. To begin with, the space available adjacent to existing roads is often too limited for the intended widening because the lateral banks of conventional roads will only permit relatively shallow slopes so that a great proportion of the available space is taken up by the bank. Secondly, in the course of excavation for widening of the road bed, the stability of the existing road is often imperiled. Thirdly, high maintenance costs may often extend over many years as long as the widened stretch is still "settling" in the subsoil, resulting in cracks where shifting takes place.

The invention aims at providing a method of the type referred to above, whereby these problems encountered in widening existing roads can be easily and efficiently solved. The method according to the invention is characterized in that flexible piles are permanently embedded in the subsoil. Transverse elements or portions of some of the piles extend in a transverse direction through at least part of the foundation. According to the invention, the piles can advantageously extend in an essentially vertical direction, but, depending on conditions, it may also be advantageous for the piles to extend into the subsoil at an angle to the vertical, this angle not exceeding 45°. According to the invention, piles as well as the transverse elements are preferably formed of synthetic filaments and/or fibers, such as polyesters, polyamides, aramides, polypropylene, and similar materials.

An efficient method is characterized, according to the invention, in that transverse elements and piles are essentially composed of strips of woven or nonwoven fabric made of thermoplastic materials. According to the invention, piles as well as transverse elements can be advantageously formed of a laminate of woven and nonwoven fabric strips of thermoplastic polymer materials. Good results are anticipated, according to the invention, from transverse elements and piles in the form of cables or flexible strips of synthetic thermoplastic materials. According to the invention, both transverse elements and piles are preferably designed so as to transport water along their longitudinal direction. For example, webs of a nonwoven material such as described in U.S. Pat. No. 3,687,759, are quite suited for this invention.

The method according to the invention is especially aimed at expanding a highway foundation, which method is characterized by flexible piles being permanently embedded or fastened in the bank of the foundation to be widened, said piles forming a unitary structure with transverse or horizontal elements extending into the expansion of the foundation, and whereby after the installation of a number of piles and transverse elements, the piles and transverse elements are covered with a layer of soil, e.g., sand, clay, gravel, etc., or mixtures, which are sometimes referred to herein collectively as foundation material. The transverse elements may be prestressed in the process.

The invention also relates to a foundation obtained according to the above-described method. The foundation according to the invention is essentially characterized in that a number of flexible piles are permanently embedded in the subsoil, said piles forming an integral structure with transverse elements extending in a transverse direction through at least part of the foundation.

Although the method according to the invention can be implemented in different ways, a preferred method is to use long strips of polyester woven fabric laminated to polyester nonwoven fabric of a width of, e.g., a few dozen centimeters, having a tensile strength of at least 1kN/cm strip width. To install strips of this type in widening an existing highway, a vertical hole is drilled into the bank of the foundation of the existing road. Depending on the condition of the soft ground and the dimensions of the structure to be added, the hole should be drilled to a depth of, e.g., 5 to 10 m., into the subsoil of the foundation. After drilling the hole, a special device is used to install a strip of polyester fabric to the bottom of said hole. This strip should be, e.g., 15 m. longer than the depth of the vertical hole. After inserting the strip in the hole, the remaining 15 meters are laid out roughly horizontally over the new, freshly poured sand layer of the foundation to be built. One or more longitudinal trenches may be dug in said layer of sand. A large number of fabric strips are similarly installed along the road to be built in approximately the same horizontal plane, at a certain distance from one another (e.g., 1 – 2 m.) in previously drilled holes. Subsequently, the horizontal strips of fabric are covered, following a certain pattern, with another layer of sand of a thickness of, e.g., ca. 50 cm., as a result of which the strips are embedded in sand and prestressed, as they are forced into the open trenches, by being top-loaded. Subsequently, a series of holes are drilled at a somewhat higher level of the former embankment, in which holes strips of fabrics are similarly introduced, said strips being subsequently laid on the aforementioned freshly poured sand layer of the foundation to be built. This process is repeated until the new foundation has reached the required height for the foundation of the existing road. The new road surface can then be conventionally applied on the road widening foundation after the necessary preliminary work has been done.

An advantage of the method according to the invention is that it permits building an embankment with a fairly steep slope, e.g., 1:1, or even steeper, without the risk of a stability problems.

This is due to the fact that the shear forces created in the sand mass of the foundation are absorbed by the horizontal strips of fabric, which are subjected thereby to tensile stresses.

Tensile stresses in the horizontal portion of the fabric strips are transmitted to the vertical portion of the fabric strips. These vertical portions of fabric strips can absorb appreciable vertical tensile forces, since they are solidly anchored in the subsoil by "collapse" of the drilled vertical hole F, whereby substantial shear stresses may be generated. Since such foundation can be provided with a steep bank by installing fabric strips in the form of transverse elements and vertical piles, only a minimum of width is required for such foundation. This will mean substantial space savings, as a result of which existing roads can in some cases be sufficiently widened to obviate the need to build a new road elsewhere.

Another advantage of the method according to the invention is that while construction of the new foundation is under way, good drainage of the subsoil is provided so that the consolidation process is distinctly accelerated and, depending upon the type of subsoil, some 80% of the final settlement can take place in about six months.

Pore-water pressure, whose pressure has increased under the weight of the foundation under construction, can be drained off vertically upward through the vertical portion of the fabric strips (piles), and subsequently is either totally or partly drained off laterally through the horizontal portion of the fabric strips (transverse elements) to the sides of the foundation.

Moreover, with the method of the invention, widening of an existing road does not affect the stability of the existing road to any degree, since during construction of the new foundation, a combination of reinforcing and drainage by the horizontal fabric strips (transverse elements) takes place, whereas underground draining and reinforcing is insured by the vertical portions of the fabric strips (piles). Hence, a double function is performed by the installed fabric strips forming transverse elements and piles. In widening an existing road according to the method of the invention, it will often be unnecessary to start by excavating the subsoil adjacent to the existing road. The shear resistance of the subsoil is increased by the reinforcement.

To determine the tensile forces that can be absorbed by the strips (piles) fastened into the ground, the following test was performed.

A number of vertical holes of a depth of roughly 6 m. were drilled through a top layer of 2 m. sand poured on a thick layer of cohesive and compactable soil mainly composed of clay and peat. Woven nylon strips of 30 cm. width were inserted into the drilled holes. Field measurements indicated that the force required to pull such strips from the ground, depending upon speed, time after installation and location varies between some 6 – 20 kilo newtons (hereafter, kN). Using the well-known theories of horizontal and vertical soil stresses, it was calculated that due to friction in the 2 m.-thick sand layer, but mainly due to cohesion and friction in the vertically loaded 4 m. thick clay-peat stratum, a force of 15.7 kN. is needed to pull such strips from the ground. For this calculation, the following values were assigned to a number of factors relating to the sand and clay-peat layer:

sand - no cohesion, i.e., cohesion $c = 0$ kN/m$^2$
angle of internal friction = 30°
specific mass s.m. = 1600 kg/m$^3$
coefficient of friction sand-strip $f = 0.6$ (determined via laboratory measurements)
clay-peat - cohesive, cohesion $c = 4$ kN/m$^2$
angle of internal friction = 4°
specific mass s.m. = 1200 kg/m$^3$
coefficient of friction clay/peat-strip
$f \triangleq 0.02$ The invention will be explained in more detail with the aid of schematic drawings.

DESCRIPTION OF THE DRAWINGS

FIGS. 1 and 2 show only the cross-section of the foundation on one side of the road widening to be built. The foundation of the existing road is identified by 1, the road surface of the existing road by 2. A drainage ditch 3 runs along the road.

Figure 1:
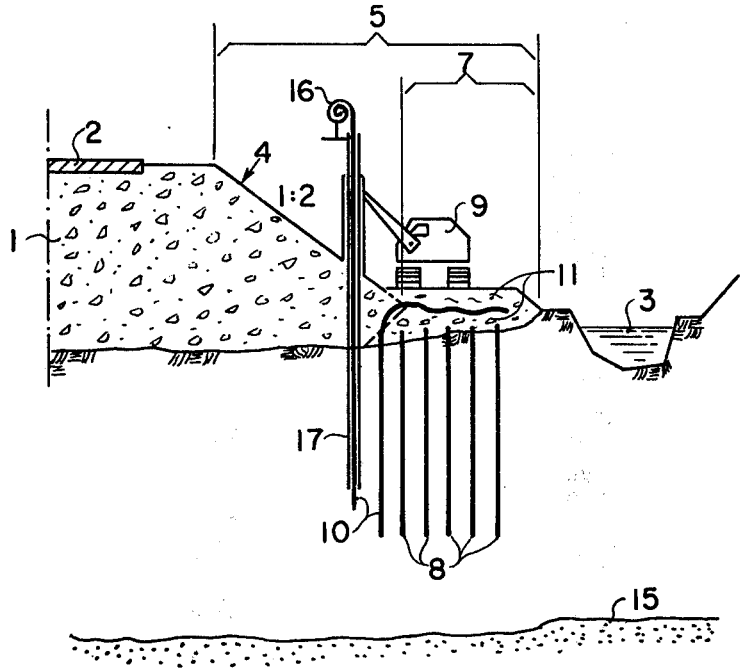
FIG. 1 shows a foundation cross-section for a road widening under construction.
Figure 2:
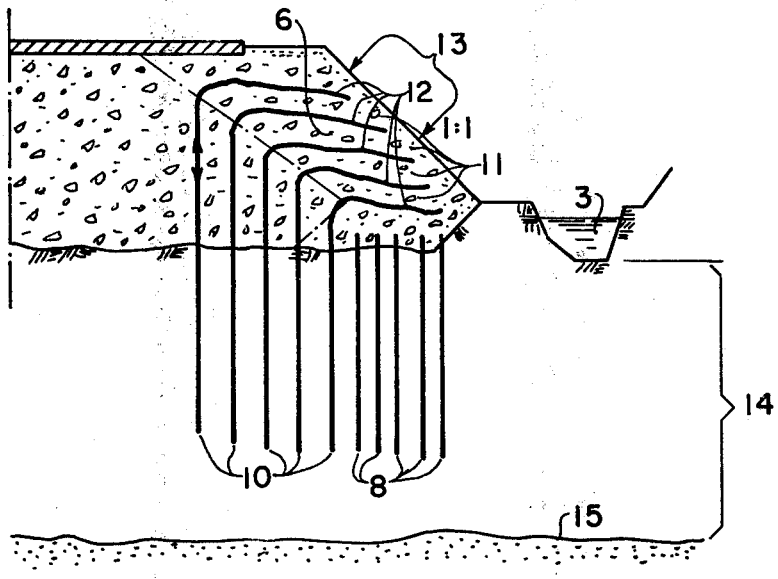
FIG. 2 shows a foundation cross-section for a completed road widening.

The bank of the old foundation 1 has a slope of 1:2. Between bank 4 of existing foundation 1 and ditch 3, space is available to accomodate widening of the road. Before starting on the new foundation 6, it is advisable to take steps to drain and reinforce a flat strip of ground 7 and the underlying soft strata, which strip is still free beyond foundation 1 of the old road. Such drainage and reinforcing can be accomplished by providing strip 7 with a number of vertical drainage and reinforcing piles in the form of woven and/or nonwoven fabric strips 8. Subsequently, a great number of vertical piles 10 in the form of strips 8 are inserted in bank 4 of the existing foundation 1 by drilling holes of sufficient depth.

Then, the piles can be unwound from a roll 16 and inserted through casings 17 placed in the drilled holes. The casings 17 can be supported and held in place by a crane 9 and removed thereafter to permit the holes to collapse due to consolidation.

The fabric strips for vertical piles 10 as much longer than the depth of the holes or the length of the piles so that a several-meters long fabric strip is protruding from every hole. These protruding fabric strips are arranged approximately horizontally on successively applied soil layers 11 of the new foundation for road widening. Horizontal strips 12 form the transverse elements in the foundation for widening of the road.

In the completed foundation 6 for widening of the road, piles 10 and transverse elements 12 form a unitary structure since each pile 10 together with the corresponding transverse element 12 consists of a single strip.

Transverse elements 12 form the reinforcement of foundation 6, so that bank 13 of the newly added foundation 6 can be given a steeper slope, e.g., 1:1, than former bank 4. The method according to the invention is particularly meant to be used in areas with a compressible subsoil. In the drawing, the area of soft ground is identified by 14 and the underlying, better bearing sand layer is identified by 15.

Modifications are possible within the framework of the invention. For instance, instead of woven fabric strips, other materials can be used, e.g., nonwoven strips, cables or flexible metal strips, which like the above-mentioned fabric strips can absorb sufficient tensile load and provide for water drainage at the same time. Also, the free end of the approximately horizontal transverse elements or strips should be devised to include means to prevent breaking through the sand or soil layer between successive transverse elements. The latter may be accomplished, for instance, by making a loop at the free end of the transverse element, which loop is filled with fill material. Although the emphasis is on using the method according to the invention for road widening, said method according to the invention can also be advantageously used for the construction of new or partly new foundations for highways, dikes, factory complexes, artificial islands, etc. The method according to the invention is meant especially for the construction of road foundations and the like on cohesive and compressible subsoils.

What is claimed is:

1. A method for the preparation of a foundation, and especially a structure serving as foundation for highways, comprising permanently and deeply embedding a plurality of flexible piles in the subsoil so that a first portion of each of said piles extends from essentially a vertical direction to an angle of about 45° to the vertical and extending a second portion of at least one of said piles in a transverse direction through at least part of the foundation.

2. The method of claim 1 wherein said piles and said transverse portions are formed essentially of strips of synthetic, thermoplastic polymer materials.

3. The method of claim 2 wherein said synthetic thermoplastic, polymer synthetic materials are filaments or fibers or mixtures thereof selected from the group consisting of polyesters, polyamides, aramides and polypropylene.

4. The method of claim 3 wherein said piles and said transverse portions are formed essentially of a laminate of said strips of synthetic, thermoplastic polymer materials.

5. The method of claim 2 wherein said piles and said transverse portions are adapted to transport water in their longitudinal direction.

6. The method of widening the foundation of a highway comprising permanently and deeply embedding a plurality of flexible piles in the compressible subsoil underlying the embankment of said highway to be widened so that a first portion of each of said piles extends from a vertical direction to an angle of 45° to the vertical and extending a second portion of at least one of said piles in a transverse direction covering each of said transverse portions with a layer of foundation material.

7. A method according to claim 6 wherein the transverse portions are prestressed.

8. A foundation comprising soil and a plurality of flexible piles permanently and deeply fastened in the subsoil, each of said piles having a first portion extending in a direction from the vertical to an angle of 45° from the vertical and at least one of said piles having a second portion extending in a transverse direction through at least part of the foundation.

9. The foundation according to claim 8 wherein said piles are formed of strips of synthetic thermoplastic materials.

10. The foundation according to claim 9, wherein said piles are filaments thereof selected from the group consisting of polyesters, polyamides, aramides, and polypropylene.

11. The foundation to claim 10, wherein said piles are essentially formed of a laminate of woven and nonwoven strips of synthetic, thermoplastic polymer materials.

12. Foundation according to claim 11, wherein said transverse portions are prestressed and said piles are covered with foundation material.

* * * * *